US006158620A

United States Patent [19]

Polan

[11] Patent Number: 6,158,620

[45] Date of Patent: Dec. 12, 2000

[54] COLLAPSIBLE CONTAINER

[75] Inventor: David L. Polan, Mason, Ohio

[73] Assignee: Chester Labs, Inc., Cincinnati, Ohio

[21] Appl. No.: 09/266,227

[22] Filed: Mar. 10, 1999

Related U.S. Application Data

[63] Continuation-in-part of application No. 29/100,472, Feb. 11, 1999.

[51] Int. Cl.[7] ..... B65D 35/00

[52] U.S. Cl. ..... 222/92; 222/107

[58] Field of Search ..... 222/92, 107

[56] References Cited

U.S. PATENT DOCUMENTS

| | | | |
|---|---|---|---|
| D. 17,381 | 6/1887 | Sterret . | |
| D. 32,027 | 12/1899 | Kronkosky . | |
| D. 45,565 | 4/1914 | Lloyd . | |
| D. 129,158 | 8/1941 | Dexter . | |
| D. 157,498 | 2/1950 | Kestenbaum . | |
| D. 203,006 | 11/1965 | Hulterstrum | D58/6 |
| D. 205,381 | 7/1966 | Kelly | D58/6 |
| D. 207,802 | 5/1967 | Du Pree | D58/6 |
| D. 211,625 | 7/1968 | Du Pree | D9/123 |
| D. 218,284 | 8/1970 | Du Pree | D9/128 |
| D. 218,318 | 8/1970 | Heintze | D9/129 |
| D. 223,808 | 6/1972 | Beaver | D9/44 |
| D. 232,521 | 8/1974 | Roche | D9/168 |
| D. 234,019 | 12/1974 | D'Alo | D9/44 |
| D. 248,836 | 8/1978 | Anderson | D9/167 |
| D. 258,347 | 2/1981 | De Luca | D9/372 |
| D. 259,173 | 5/1981 | Lauren | D9/401 |
| D. 281,577 | 12/1985 | Larson et al. | D9/367 |
| D. 282,349 | 1/1986 | Larson et al. | D9/395 |
| D. 284,835 | 7/1986 | Banks | D9/367 |
| D. 294,462 | 3/1988 | Ota et al. | D9/392 |
| D. 294,463 | 3/1988 | Lang | D9/392 |
| D. 310,778 | 9/1990 | Williamson | D9/367 |
| D. 312,395 | 11/1990 | Norman | D9/370 |
| D. 333,269 | 2/1993 | Albright et al. | D9/544 |
| D. 339,291 | 9/1993 | Leigner | D9/520 |
| D. 350,070 | 8/1994 | Ophardt | D9/521 |
| D. 372,675 | 8/1996 | Pollard et al. | D9/542 |
| D. 376,762 | 12/1996 | Fenton et al. | D9/549 |
| D. 388,711 | 1/1998 | Wacker | D9/544 |
| 2,400,716 | 5/1946 | Sattler | 222/107 |
| 3,354,924 | 11/1967 | Birrell et al. | 222/92 |
| 3,595,441 | 7/1971 | Grosjean | 222/107 |
| 3,727,803 | 4/1973 | Cobb | 222/215 |
| 3,926,341 | 12/1975 | Lhoest | 222/95 |
| 4,387,816 | 6/1983 | Weckman | 215/1 C |
| 4,805,788 | 2/1989 | Akiho | 215/1 C |
| 4,877,141 | 10/1989 | Hayashi et al. | 215/1 C |
| 5,064,081 | 11/1991 | Hayashi et al. | 215/1 C |
| 5,092,474 | 3/1992 | Leigner | 215/1 C |
| 5,170,910 | 12/1992 | Hamm | 222/92 |
| 5,174,458 | 12/1992 | Segati | 215/1 C |
| 5,178,290 | 1/1993 | Ota et al. | 215/1 C |
| 5,199,587 | 4/1993 | Ota et al. | 215/1 C |
| 5,199,588 | 4/1993 | Hayashi | 215/1 C |
| 5,299,710 | 4/1994 | Welsch et al. | 220/675 |
| 5,316,184 | 5/1994 | During | 222/107 |
| 5,526,958 | 6/1996 | Kuppersbusch | 222/105 |
| 5,556,005 | 9/1996 | Banks | 222/96 |
| 5,609,899 | 3/1997 | Spector | 222/107 |
| 5,731,021 | 3/1998 | Spector | 222/107 |
| 5,960,993 | 10/1999 | Mitsui et al. | 222/92 |

FOREIGN PATENT DOCUMENTS

| | | | |
|---|---|---|---|
| 2361103 | 12/1972 | Germany | 222/107 |

*Primary Examiner*—Joseph A. Kaufman
*Attorney, Agent, or Firm*—Wood, Herron & Evans, LLP

[57] ABSTRACT

There is provided a collapsible container for dispensing liquid products, such as soap. The collapsible container is provided with V-shaped hinged portions at either end of a vertical hinge line on the sides of the container to allow inward collapse of the container and recessed panels on the front and back of the container to provide rigidity to the structure, thus allowing a controlled collapse as well as rapid filling of the collapsible container with the liquid soap.

27 Claims, 1 Drawing Sheet

COLLAPSIBLE CONTAINER

CROSS REFERENCE TO RELATED APPLICATION

This application is a continuation-in-part application of U.S. Design patent application Ser. No. 29/100,472 filed Feb. 11, 1999 entitled "Collapsible Container Body".

FIELD OF THE INVENTION

This invention relates to a collapsible container for containing fluids, such as liquid soap, to be dispensed to a user through a dispensing device.

BACKGROUND OF THE INVENTION

Containers made of flexible or semi-rigid plastic material are already known in the art, comprising such materials as polyvinyl chloride, polyethylene, polypropylene and polycarbonate. Many types of liquid soaps and detergents for personal hygiene are supplied in such containers, which are designed to be inserted into dispensers provided with hand-actuated pumps. Many of the dispensers are designed such that, as liquid is pumped from the container, air back flows into the container to replace the displaced liquid. This can lead to degradation and shortened lifetime of the liquid due, for example, to oxidation and contamination. In addition, evaporation of the liquid occurs, causing thickening of the soap and may result in blockages of the pumping mechanism.

An alternative is to provide a collapsible container, such as described in U.S. Pat. No. 5,556,005. In this patent, there is described a container and valve assembly combination whereby as liquid is dispensed from the container by vacuum or suction, the air-tight seal at the valve assembly prevents air from being drawn into the container so that the container slowly collapses as the liquid volume decreases. Collapsible containers such as described in the referenced patent reduce exposure of the liquid soap to air by collapsing the container, which decreases oxidation and contamination of soaps contained therein, thus increasing the useful life of the liquid.

A problem occurs when attempting to design a collapsible container for use in soap dispensers, such as that described in U.S. Pat. No. 5,556,005. Specifically, when the liquid soap is filled in the container, the high speed filling process tends to cause bulging in the container side panels and/or front and back panels. This bulging prevents or hampers high speed filling of the containers and creates fit problems when such bulging containers are installed in dispenser housings.

There is thus a need to provide a collapsible container for use in soap dispenser or other liquid dispensers such that the container efficiently collapses upon evacuation of the liquid contents and furthermore does not unduly bulge during filling of the container with the liquid contents.

SUMMARY OF THE INVENTION

The present invention provides a collapsible container for use in liquid dispensing apparatuses in which the container collapses controllably as liquid is evacuated, and which has sufficient structural stiffness to prevent undue bulging of the container under high speed filling conditions. To this end and in accordance with the principles of the present invention, there is provided a container having a front and back each with a recessed central panel, which provides strength to the structure and reduces the amount of bulging that occurs during high speed filling. The container is further provided with sides that contain a vertical centrally-located hinge line with V-shaped hinge portions extending from the upper and lower ends thereof to facilitate the collapse of the container upon evacuation of the contents thereof. The foregoing combination of the features of the front, back and sides of the collapsible container of the present invention collectively provides a liquid container that is capable of being filled at high speeds without bulging and subsequently evacuated of substantially all the contents thereof without the entry of air into the interior of the container.

These and other objects and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Figure 1:
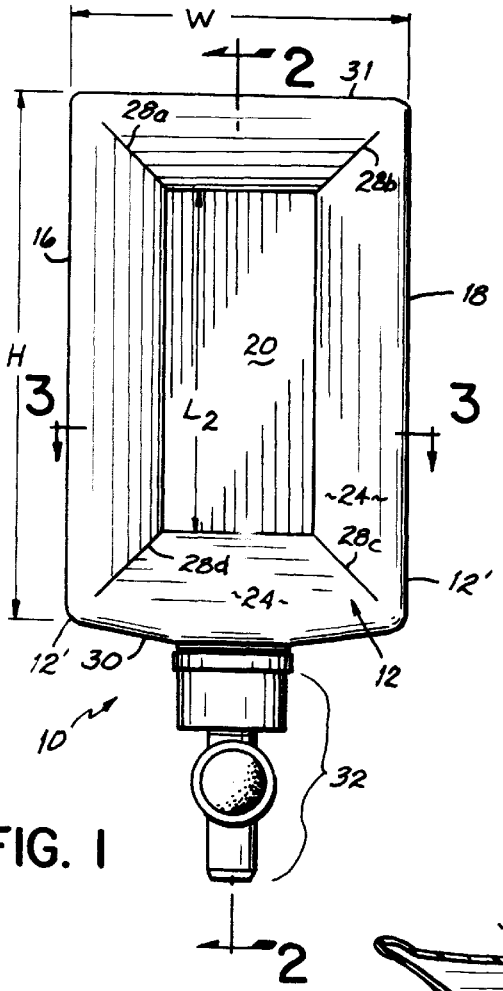
FIG. 1 is a front elevational view of a collapsible container in accordance with the invention.
Figure 2:
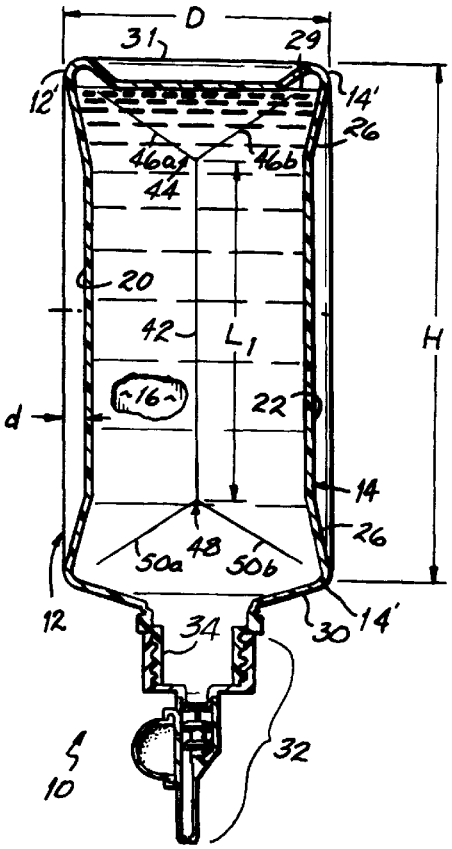
FIG. 2 is a cross-sectional side view of the collapsible container of FIG. 1 taken along line 2—2.
Figure 3:
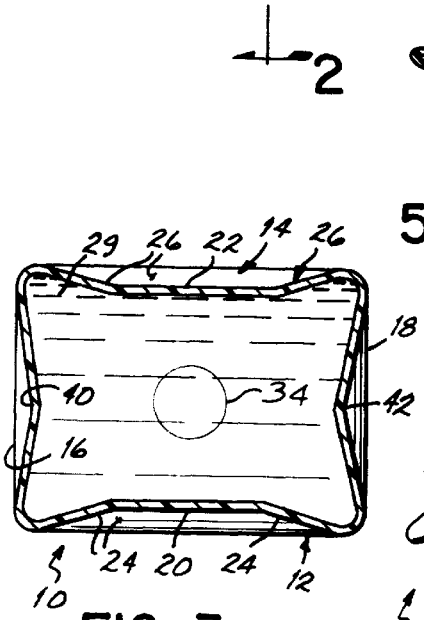
FIG. 3 is a cross-sectional view of the container of FIG. 1 taken along line 3—3.

As shown in FIGS. 1, 2 and 3, the collapsible container 10 of the present invention has a generally rectangular block shape with an identically configured front 12 and back 14, and identically configured sides 16 and 18. The height H of the container 10 measured from top 30 to bottom 31 is advantageously greater than the depth D, as measured from the front 12 to the back 14. The height H is also advantageously greater than the width W, as measured between the sides 16 and 18. The collapsible container 10 is shown in the in-use inverted position where the top 30 of the container is disposed downwardly for dispensing the liquid contents 29. The collapsible container 10 is shown connected to a bulb-type pressure valve assembly 32 as shown and described in U.S. Pat. No. 4,330,071, incorporated by reference herein in its entirety. This valve assembly 32 prevents air from being drawn into the container when liquid is being dispensed therefrom so that the container will collapse as the volume of the liquid remaining in the container decreases. It is to be understood, however, that other valve assemblies may be used in accordance with the principles of the present invention. The combination of the container 10 and the valve assembly 32 is adapted to be inserted into a dispenser housing, such as that described and claimed in U.S. patent application Ser. No. 09/266,226, entitled "Hinged Dispenser Housing", David L. Polan, filed Mar. 10, 1999, assigned to the assignee of the present invention and incorporated herein by reference in its entirety.

As shown in FIGS. 1–3, front 12 has a centrally located, recessed panel 20. Back 14 has an identical centrally located, recessed panel 22. The depth d of the recessed panels 20,22 relative to the peripheries 12' and 14' of the front 12 and back 14 is uniform throughout. Thus, the panels 20,22 are substantially planar relative to the front 12 and back 14. Annular, beveled regions 24,26 surround the front and back recessed panels 20,22, respectively. Hinge lines 28*a,b,c,d* extend from each corner of the front recessed panel 20 across beveled region 24 outwardly to the corners of the front 12 of the container 10. Identical hinge lines (not shown) are found on the back 14 of the container 10 in the same relative position as are the hinge lines 28*a–d* on the front 12.

The sides 16,18 of the container 10 each have a vertical hinge line 40,42, respectively, in the center of the panel, preferably having a length $L_1$ equal to the vertical length $L_2$ of the front and back recessed panels 20,22. As shown in FIG. 2, at the upper end of vertical hinge line 42 of side 18 is a V-shaped hinge portion 44 comprising a pair of hinge lines 46*a,b* that extend outwardly from the top end of vertical hinge line 42 toward a respective top corner of side 18. At the lower end of vertical hinge line 42 is a second V-shaped hinge portion 48 comprising a pair of hinge lines 50*a,b* that extend outwardly from the bottom end of vertical hinge line 42 toward a respective bottom corner of side 18. On side 16 (not shown), vertical hinge line 40 also terminates at each end in a V-shaped hinge portion (not shown) as described for side 18.

The vertical hinge lines 40,42 and the V-shaped hinge portions 44,48 together with the front and back recessed panels 20,22 and front and rear hinge lines 28*a–d* permit container 10 to inwardly collapse in a controlled manner as the liquid contents 29 thereof are removed without admitting into container 10 a corresponding volume of ambient air. This configuration further allows a nearly complete evacuation of all liquid 29 from container 10, thus reducing waste of the liquid contents. The front and back recessed panels 20,22 further provide an anti-bulging characteristic to collapsible container 10, allowing the container to be filled with liquid 29 at high speed without bulging. The recessed panels 20,22 in combination with the beveled regions 24 and 26 provide stiffness to the container structure to allow it to withstand high speed filling without bulging, yet allow controlled container collapse and evacuation of the maximum amount of liquid 29 in response to repeated dispensing by a user. The recessed panels 20,22 further provide a convenient location for the placement of labels by high speed automatic label applicators.

Figure 4:
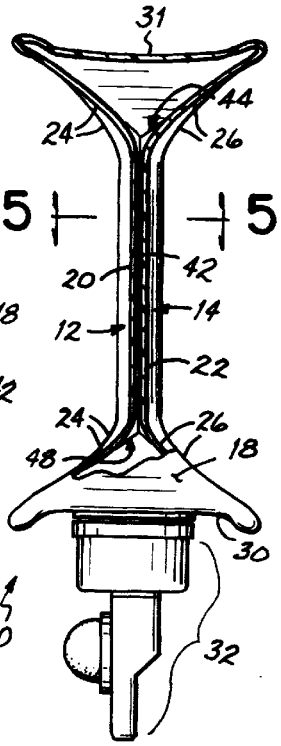
FIG. 4 is a partial cross-sectional side view of a fully collapsed container in accordance with the principles of the present invention.
Figure 5:
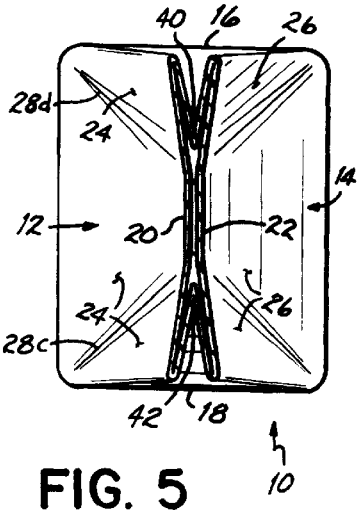
FIG. 5 is a cross-sectional view of the fully collapsed container of FIG. 4 taken along line 5—5.

The bottle collapses to the fully collapsed condition as shown in FIGS. 4 and 5 as substantially all of the liquid contents 29 are dispensed therefrom. The V-shaped hinge portions 44,48 on side 18 and the corresponding V-shaped portions on side 16 (not shown), allow the vertical hinge lines 40,42 to move inwardly toward each other toward the interior of the bottle, drawing the front and back 12,14 inwardly, such that upon a complete evacuation the front and back 12,14 are substantially touching, as shown in FIG. 5. Because the collapsible containers are typically inserted within a dispenser housing, the controlled collapse of the side panels inwardly prevents the bottle from growing larger in any dimension, so that it collapses completely within the dispenser housing.

The top 30 of container 10 is provided with an opening 34 through which the product is filled and dispensed. After filling, the container 10 may be connected to a pressure valve assembly 32 such as described in the U.S. Pat. No. 4,330,071 or any other suitable valve that preferably prevents air from being drawn into the container during dispensing. Opening 34 may be provided with a threaded portion for connecting to a threaded portion of a valve housing, or may be provided with any other suitable connecting device.

The collapsible container 10 of the present invention may be fabricated of polyethylene, and advantageously is fabricated of a polymer mixture. By way of example, 100% low density polyethylene will produce an acceptable container suitable for most applications. For a more rigid but still collapsible container with lighter weight, thinner wall thicknesses and lower cost, a blend of high density and low density polyethylene is effective, such as 25%–75% high density and 25%–75% low density polyethylene. Also, as the container collapses during normal use, certain surfaces of the container walls experience significant bending stresses which may cause failure and/or leakage during the life of the container under certain circumstances. Thus, for high resistance to stress cracking of the container in extreme conditions of high heat and/or chemically aggressive contents, the addition of linear low density polyethylene is effective. For example, the container may be a blend of 30%–70% high density polyethylene, 25%–75% low density polyethylene, and 10%–50% linear low density polyethylene. The container may also be molded with 100% linear low density polyethylene, but this is somewhat cost-prohibitive. A two part blend of linear low density polyethylene with either high or low density polyethylene is also possible. The polymer resins useful in the practice of the present invention may be obtained from a wide variety of sources. For example, high density polyethylene is sold commercially by Paxon Polymer Co., Baton Rouge, LA under product number HDPE AB55-003; low density polyethylene is sold commercially from Dow Chemical, Midland, Mich. under the product number LDPE 6401 or from Nova Chemical, Alberta, Canada under product number NOVAPOL® PD8014A; and linear low density polyethylene is sold commercially from Quantum Chemical Corp., Cincinnati, Ohio under product number PETROTHENE™ GA 818-073.

For a more controlled shape of the fully collapsed container, the wall thickness may be varied in different portions of the container. This is relatively easily accomplished with extrusion blow molding techniques, for example, where the two halves of the mold meet at the centers of the front and back of the container or diagonally across the front and back of the container. For instance, the blowmold tooling is designed to provide recessed front and back panels 20,22 having a greater thickness and weight to provide an increased rigidity to that portion of the collapsible container to further prevent bulging or buckling of the front and back of the container. These thicker panels also increase the effectiveness of high speed label application. The side panels 16,18 are thinner and more flexible to promote inward folding of these side panels, thus allowing the container 10 to collapse within the confines of its original space. The combination of the thicker recessed panels 20,22 and thinner side panels 16,18 provides a cube-shaped collapsible container that does not interfere with the operation of a dispenser housing during collapse, is aesthetically pleasing, is stable during the filling process, and is effectively labeled by high speed automatic label applicators. Additionally, the top 30 and bottom 31 of the container may have thicker panels to provide further rigidity to the collapsible container 10. The hinge lines may also have a thinner cross-section than the adjacent walls. The container may be fabricated by any known molding technique, but extrusion blow molding is preferred. By way of example, and not intended to limit the scope of the present invention, a collapsible container of the present invention may be provided with recessed panels each having a thickness of about 0.03 to about 0.06 inch and sides each having a thickness of about 0.01 to about 0.03 inch. The minimum wall thickness of any portion of the container is about 0.003 inch. The weight of the container is preferably between about 40 grams to about 55 grams. An example of preferred dimensions for the collapsible container are a height H of about 6.0 inches, a width W of about 4.0 inches, and a depth D of about 3.0 inches.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A collapsible container comprising:

a front and a back;

a first side between the front and back, and a second side between the front and back opposite the first side;

a top and a bottom;

a recessed planar panel incorporated into each of the front and back;

a vertical hinge line on each of the first and second sides;

a V-shaped hinge portion at each end of each vertical hinge line, each V-shaped hinge portion comprising a pair of hinge lines extending outwardly from a vertex at the end of the vertical hinge line toward a respective corner of the first and second sides; and an opening in the top adapted to dispense there through a liquid, whereby the recessed planar panels, vertical hinge lines and V-shaped hinge portions cooperate to allow the container to collapse inwardly without the container becoming larger in any dimension as the liquid contents of the container are reduced upon dispensing of a liquid contained therein.

2. The container of claim 1, wherein the lengths of the front, back and first and second sides are equal, the widths of the front and back are equal, and the widths of the first and second sides are equal.

3. The container of claim 2, wherein the length of the front and back is greater than the width of the front and back and greater than the width of the first and second sides.

4. The container of claim 2, wherein the recessed planar panels have length and width less than, but proportional to, the length and width of the front and back.

5. The container of claim 4, wherein the recessed planar panels are centrally located in the front and back.

6. The container of claim 4, wherein the vertical hinge lines are equal in length to the length of the recessed planar panels.

7. The container of claim 6, wherein the vertical hinge lines are centrally positioned in the first and second sides.

8. The container of claim 1, further comprising a hinge line extending from each corner of the front and back recessed planar panels outwardly to a respective corner of the front and back.

9. The container of claim 1, wherein the opening in the top comprises a threaded tubular extension adapted to engage with a threaded dispensing device.

10. The container of claim 1, the container being fabricated of polyethylene.

11. The container of claim 1, further comprising a pressure valve connected to the opening in the top for dispensing a liquid from the container without admitting air into the container.

12. The container of claim 1, wherein the recessed planar panels have a wall thickness greater than a wall thickness of the first and second sides.

13. The container of claim 1, wherein the hinge lines are thinner than a wall thickness of an adjacent wall.

14. A collapsible container comprising:

a front and a back having an equal length dimension and an equal width dimension;

a first side between the front and back, and a second side between the front and back opposite the first side, the first and second sides having an equal length dimension and an equal width dimension, and the length of the first and second sides being equal to the length of the front and back;

a top and a bottom having an equal length dimension and an equal width dimension;

a recessed planar panel on each of the front and back, the panel having length and width dimensions smaller than and proportional to the respective length and width dimensions of the front and back;

a vertical hinge line on each of the first and second sides, the vertical hinge lines having a length less than the length of the first and second sides;

a V-shaped hinge portion at each end of each vertical hinge line, each V-shaped hinge portion comprising a pair of hinge lines extending outwardly from a vertex at the end of the vertical hinge line toward a respective corner of the first and second sides; and an opening in the top adapted to dispense there through a liquid, whereby the recessed planar panels, vertical hinge lines and V-shaped hinge portions allow the container to collapse inwardly without the container becoming larger in any dimension upon dispensing of a liquid contained therein.

15. The container of claim 14, wherein the length of the front and back is greater than the width of the front and back and greater than the width of the first and second sides.

16. The container of claim 14, wherein the recessed planar panels are centrally located in the front and back.

17. The container of claim 14, wherein the vertical hinge lines are equal in length to the length of the recessed planar panels.

18. The container of claim 17, wherein the vertical hinge lines are centrally positioned in the first and second sides.

19. The container of claim 14, further comprising a hinge line extending outwardly from each corner of the front and back recessed planar panels to a respective corner of the front and back.

20. The container of claim 14, wherein the opening in the top comprises a threaded tubular extension adapted to engage with a threaded dispensing device.

21. The container of claim 14, the container being fabricated of polyethylene.

22. The container of claim 14, further comprising a pressure valve connected to the opening in the top for dispensing a liquid from the container without admitting air into the container.

23. The container of claim 14, wherein the recessed planar panels have a wall thickness greater than a wall thickness of the first and second sides.

24. The container of claim 14, wherein the hinge lines are thinner than a wall thickness of an adjacent wall.

25. A collapsible container comprising:

a front and a back;

a first side between the front and back, and a second side between the front and back opposite the first side, the first and second sides being connected to the front and back by rounded edge portions;

a top and a bottom;

each of the front and back comprising a peripheral portion and a recessed planar panel bound by the peripheral portion, the peripheral portion connecting the recessed planar panel to the top and bottom and to the rounded edge portions;

a vertical hinge line on each of the first and second sides;

a V-shaped hinge portion at each end of each vertical hinge line, each V-shaped hinge portion comprising a pair of hinge lines extending outwardly from a vertex at the end of the vertical hinge line toward a respective corner of the first and second sides; and an opening in the top adapted to dispense there through a liquid, whereby the recessed planar panels, vertical hinge lines and V-shaped hinge portions cooperate to allow the container to collapse inwardly as the liquid contents of the container are reduced upon dispensing of a liquid contained therein.

26. A collapsible container comprising:

a front and a back;

a first side between the front and back, and a second side between the front and back opposite the first side;

a top and a bottom;

a recessed planar panel incorporated into each of the front and back;

a hinge line extending from each corner of the front and back recessed planar panels outwardly to a respective corner of the front and back;

a vertical hinge line on each of the first and second sides;

a V-shaped hinge portion at each end of each vertical hinge line, each V-shaped hinge portion comprising a pair of hinge lines extending outwardly from a vertex at the end of the vertical hinge line toward a respective corner of the first and second sides; and an opening in the top adapted to dispense there through a liquid, whereby the recessed planar panels, vertical hinge lines and V-shaped hinge portions cooperate to allow the container to collapse inwardly as the liquid contents of the container are reduced upon dispensing of a liquid contained therein.

27. A collapsible container comprising:

a front and a back having an equal length dimension and an equal width dimension;

a first side between the front and back, and a second side between the front and back opposite the first side, the first and second sides having an equal length dimension and an equal width dimension, and the length of the first and second sides being equal to the length of the front and back;

a top and a bottom having an equal length dimension and an equal width dimension;

a recessed planar panel on each of the front and back, the panel having length and width dimensions smaller than and proportional to the respective length and width dimensions of the front and back;

a hinge line extending from each corner of the front and back recessed planar panels outwardly to a respective corner of the front and back;

a vertical hinge line on each of the first and second sides, the vertical hinge lines having a length less than the length of the first and second sides;

a V-shaped hinge portion at each end of each vertical hinge line, each V-shaped hinge portion comprising a pair of hinge lines extending outwardly from a vertex at the end of the vertical hinge line toward a respective corner of the first and second sides; and an opening in the top adapted to dispense there through a liquid, whereby the recessed planar panels, vertical hinge lines and V-shaped hinge portions allow the container to collapse upon dispensing of a liquid contained therein.

* * * * *